US006834603B1

(12) United States Patent
Price et al.

(10) Patent No.: US 6,834,603 B1
(45) Date of Patent: Dec. 28, 2004

(54) ATTACHMENT GUSSET WITH RUFFLED CORNERS AND SYSTEM FOR AUTOMATED MANUFACTURE OF SAME

(75) Inventors: Elvin C. Price, Dacula, GA (US); Preston B. Dasher, Lawrenceville, GA (US); John S. Chamlee, Lawenceville, GA (US); Van H. Nguyen, Lawrenceville, GA (US); Danny V. Murphy, Dacula, GA (US); George A. Price, Lawrenceville, GA (US); Stephen S. Ruderman, Lilburn, GA (US)

(73) Assignee: Atlanta Attachment Company, Lawrenceville, GA (US)

( * ) Notice: Subject to any disclaimer, the term of this patent is extended or adjusted under 35 U.S.C. 154(b) by 129 days.

(21) Appl. No.: 10/219,837

(22) Filed: Aug. 15, 2002

Related U.S. Application Data

(60) Provisional application No. 60/362,026, filed on Mar. 5, 2002.

(51) Int. Cl.[7] ..... D05B 21/00

(52) U.S. Cl. ..... 112/470.07; 112/2.1

(58) Field of Search ..... 112/470.07, 427, 112/18, 20, 120, 470.05, 176

(56) References Cited

U.S. PATENT DOCUMENTS

| | | | | |
|---|---|---|---|---|
| 1,947,058 | A | 2/1934 | Pittoni | 112/3 |
| 3,013,513 | A | 12/1961 | Judelson | 112/203 |
| 3,641,954 | A | 2/1972 | Kalning et al. | 112/3 |
| 4,013,026 | A | 3/1977 | Hall | 112/153 |
| 4,043,282 | A | 8/1977 | Fanghanel | 112/3 |
| 4,067,269 | A | 1/1978 | Fanghanel | 112/3 |
| 4,141,304 | A | 2/1979 | Masuda | 112/153 |
| 4,290,376 | A | 9/1981 | Brusasca et al. | 112/121.26 |
| 4,498,404 | A | 2/1985 | Sadeh | 112/121.12 |
| 4,691,651 | A | 9/1987 | Junemann | 112/259 |
| 4,703,706 | A | 11/1987 | Plante | 112/265.1 |
| 4,742,789 | A | 5/1988 | Pestel et al. | 112/262.3 |
| 4,776,579 | A | 10/1988 | Romand et al. | 271/228 |
| 4,794,873 | A | 1/1989 | Dordi et al. | 112/2.1 |
| 4,813,364 | A | 3/1989 | Boser | 112/304 |
| 4,821,656 | A | 4/1989 | Dordi et al. | 112/2.1 |
| 4,825,787 | A | 5/1989 | Babson et al. | 112/262.3 |
| 4,827,856 | A | 5/1989 | Rohr | 112/63 |
| 4,838,186 | A | 6/1989 | Resta et al. | 112/2.1 |
| 4,905,615 | A | 3/1990 | Pofferi | 112/2.1 |
| 4,958,579 | A | 9/1990 | De Weers | 112/2.1 |

(List continued on next page.)

FOREIGN PATENT DOCUMENTS

| | | | |
|---|---|---|---|
| DE | 31 39426 A1 | 4/1983 | D05B/21/00 |
| DE | 37 12493 A1 | 5/1987 | D05B/21/00 |
| EP | 0264 618 A1 | 4/1988 | D05B/11/00 |
| EP | 0 200 368 B1 | 10/1990 | D05B/25/00 |
| GB | 1384073 | 2/1975 | D05B/27/00 |
| WO | WO 92/12282 | 7/1992 | D05B/11/00 |
| WO | WO 95/25194 | 9/1995 | D05B/21/00 |

*Primary Examiner*—John Calvert
*Assistant Examiner*—Brian Kauffman
(74) *Attorney, Agent, or Firm*—Womble Carlyle Sandridge and Rice, PLLC

(57) ABSTRACT

An apparatus for attaching a gusset to a panel includes a gusset folder that receives and folds a gusset material to form the gusset. The panel is supported by a sewing table. A sewing machine is positioned relative to the sewing table so as to be able to sew the gusset to the panel. A gusset guides the gusset toward a selected edge of the panel so that the gusset is held in substantial alignment with the edge of the panel. An edge detector detects when a next edge of the panel is approaching the sewing machine. A turning mechanism is positioned along the sewing table and is moveable into engagement with the panel. The turning mechanism turns the panel relative to the sewing machine when the edge detector detects the next edge of the panel is approaching the sewing machine.

48 Claims, 8 Drawing Sheets

U.S. PATENT DOCUMENTS

| | | | | |
|---|---|---|---|---|
| 4,998,965 | A | 3/1991 | Easom | 112/305 |
| 5,018,462 | A | 5/1991 | Brocklehurst | 112/121.12 |
| 5,282,433 | A | 2/1994 | Freermann et al. | 112/153 |
| 5,289,788 | A | 3/1994 | Fukumoto | 112/121.12 |
| 5,341,755 | A | 8/1994 | Kawasaki | 112/263 |
| 5,367,968 | A | 11/1994 | Diaz | 112/262.3 |
| 5,529,004 | A | 6/1996 | Porter et al. | 112/470.03 |
| 5,560,308 | A | 10/1996 | Eto | 112/470.07 |
| 5,586,511 | A | 12/1996 | Porter et al. | 112/2.1 |
| 5,647,293 | A | 7/1997 | Price et al. | 112/470.17 |
| 5,809,919 | A | 9/1998 | Mitchell et al. | 112/470.07 |
| 5,915,319 | A | 6/1999 | Price et al. | 112/470.16 |
| 6,000,352 | A | 12/1999 | Porter et al. | 112/470.12 |
| 6,055,921 | A | 5/2000 | Olewicz et al. | 112/475.07 |
| 6,202,579 | B1 | 3/2001 | Olewicz et al. | 112/2.1 |
| 2002/0050117 | A1 | 5/2002 | Dasher et al. | 53/117 |

ATTACHMENT GUSSET WITH RUFFLED CORNERS AND SYSTEM FOR AUTOMATED MANUFACTURE OF SAME

CROSS REFERENCE TO A PROVISIONAL APPLICATION

This patent application claims priority on Provisional Application Ser. No. 60/362,026, filed on Mar. 5, 2002, the entirety of which is hereby incorporated by reference.

BACKGROUND OF THE INVENTION

The present invention relates to sewn articles and sewing operations and, more particularly, to sewn attachment of different pieces of material by gussets.

In the sewn construction of padded articles, such as mattresses and furniture cushions, a padded layer or layers may be enclosed in upholstery and attached by a gusset to an accompanying pad or spring unit. For example, in a pillow-top style mattress, a pillow-top is attached to a panel by a gusset, which in one form is a folded band of material sewn along a fold line to the panel, and then sewn to a flange (which is subsequently stapled to the mattress) along the first edge opposite the fold and sewn to the pillow-top along the second edge opposite the fold, thereby attaching the pad to the mattress. At corners of the panel to which the gusset is sewn, the gusset is mitered at a seam to allow the gusset to turn the ninety degree corner of the mattress. The mitering of the gusset at the corners requires at least one miter cut to be made in the gusset at each right angle corner of the adjoining panel. Each of the mitered corner cuts must be precisely measured and individually sewn so that the gusset forms a closed structure between the mattress and the pillow-top. In a manual assembly process, the gusset is separately constructed by sewing together each leg of the gusset at the mitered corners to form a gusset frame which matches the mattress panel. The gusset is then sewn to the edges of the panel of the mattress by a tape edge. Thereafter, the pillow-top is attached to the other free edge of the gusset by a second tape edge. If the miter cuts at the corners of the gusset are not made at the correct angles, the gusset corner will not have a smooth contour or appearance. Also, in articles where the gusset remains visible, the multiple seams in the gusset are unsightly and vulnerable to separation. Constructing a gusset this way is a tedious manual production process which adds significantly to the cost of producing pillow-top mattresses and similar sewn articles.

Therefore, there is a need for a mattress having a continuously cornered gussets. There is also a need for a system for producing mattresses having continuously cornered gussets. There is also a need for a system that combines the process for sewing the flange and the gusset to the panel, or for a system the eliminates the need for a flange.

SUMMARY OF THE INVENTION

The disadvantages of the prior art are overcome by the present invention which, in one aspect, is an apparatus for attaching a gusset to a panel that includes a gusset folder that receives and folds a gusset material to form the gusset for attachment to the panel. The panel is received on and supported for sewing by a sewing table. A sewing machine is positioned relative to the sewing table so as to be able to sew the gusset to the panel. A gusset guide guides the gusset fed to the sewing machine toward a selected edge of the panel so that the gusset is held in substantial alignment with the edge of the panel. An edge detector detects when a next edge of the panel is approaching the sewing machine. A turning mechanism is positioned along the sewing table and is moveable into engagement with the panel. The turning mechanism turns the panel relative to the sewing machine when the edge detector detects the next edge of the panel is approaching the sewing machine.

In another aspect, the invention is a method of sewing a gusset to a panel, in which the gusset is sewn to the panel along a first substantially linear path with a sewing machine. A corner of the panel is detected. The panel is turned when the corner of the panel approaches the sewing machine so that the gusset follows a curved path adjacent the corner of the panel. The gusset is sewn to the panel along a second substantially linear path, angularly divergent from the from the first substantially linear path, after the gusset has been sewn around the corner of the panel.

In another aspect, the invention is an apparatus for sewing a gusset and a flange to a panel. The apparatus includes a first reel holding a gusset material and a second reel holding a flange material. A folding device folds the gusset material from the first reel along a substantially linear path. A first sewing machine receives the gusset material from the folding device and the flange material from the second reel and sews the gusset material to the flange material, thereby forming a gusset-flange. A second sewing machine receives the gusset-flange from the first sewing machine and sews the gusset-flange to the panel.

In another aspect, the invention is a gusset for attachment to a panel that has at least one first corner. The gusset includes a strip of gusset material having a first edge and a second edge. The strip of gusset material is folded substantially along a centerline and the first edge of the gusset material is sewn to the first panel. The gusset defines at least one pleat that causes the gusset material to change direction. The pleat is placed adjacent to the first corner.

In another aspect, the invention is a mattress having a first panel over one side of a mattress inner-spring. The mattress includes a gusset attached substantially about a perimeter of the first panel. The gusset is made of an elongated piece of material folded along a length dimension. The gusset is attached to the first panel proximate to a fold in the gusset material. A first edge of the gusset opposite the fold is attached to a perimeter of the first panel. A second edge of the gusset is adapted for attachment to a second panel. The gusset includes at least one corner that has at least one pleat forming a ruffled gusset corner.

In another aspect, the invention is an outer layer for attaching a pillow-top to a mattress that includes a panel having at least one outer end. A gusset includes a strip of gusset material that has a first edge and an opposite second edge and that has been folded substantially in half along a fold line so the first edge is substantially adjacent the second edge. The gusset is sewn to panel along a line adjacent the fold line and near the outer end of the panel so that the outer end extends beyond the first edge and so that the second edge has sufficient distance to provide an attachment surface on the panel to enable attaching the outer layer to the mattress.

These and other aspects of the invention will become apparent from the following description of the preferred embodiments taken in conjunction with the following drawings. As would be obvious to one skilled in the art, many variations and modifications of the invention may be effected without departing from the spirit and scope of the novel concepts of the disclosure.

DETAILED DESCRIPTION OF THE INVENTION

Figure 1:
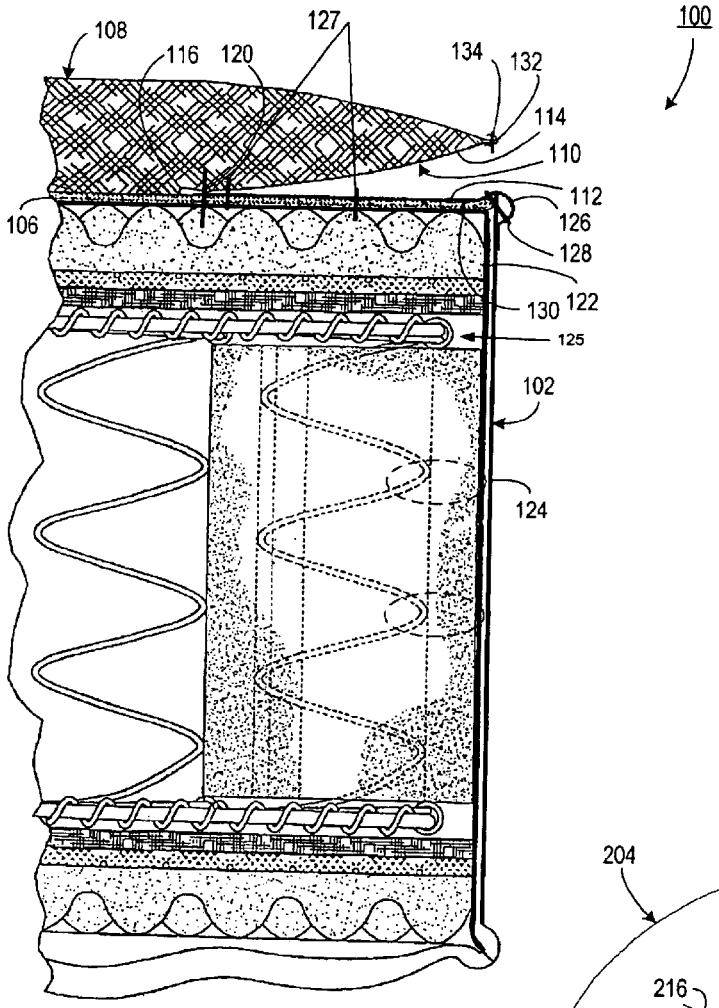
FIG. 1 is a cross-sectional view of a mattress constructed according to an illustrative embodiment of the invention.

A preferred embodiment of the invention is now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on."

As shown in FIG. 1, a pillow-top mattress 100, according to one illustrative embodiment of the invention, includes a main mattress body 102 and a pillow-top portion 108 attached to the mattress body 102 with a gusset 110. The gusset 110 is folded in half along a centerline 116 and sewn to a panel 106 along a stitch line 120 so as to have a first edge 112 and a second edge 114. A strip of flange material 122 is sewn to the periphery of the panel 106, along stitch line 120. The flange is also attached to the first edge 112 by stitches 127. The flange material 122 extends from the outermost edge of the panel 106 and is stapled to a spring unit 125 of the mattress body 102. A strip of fabric tape 126 is sewn to the first edge 112, along stitch line 128, and the side wall 124 along stitch line 128, thereby securing the gusset 110 to the mattress body 102.

The second edge of the gusset is aligned with the outermost edge of the pillow-top 108 and a strip of fabric tape 132 is sewn around the junction of the gusset 110 and the pillow-top 108 along a stitch line 134, thereby securing the panel 106 (and thus the mattress body 102) to the pillow-top.

Figure 2:
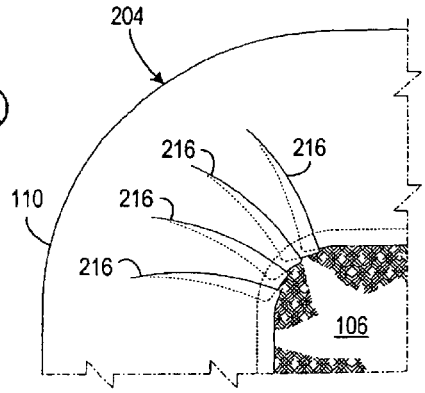
FIG. 2 is a top plan view of a portion of a ruffled gusset according to an illustrative embodiment of the invention.

As shown in FIG. 2, as the gusset 110 is being sewn to the panel 106, when a corner 204 of the panel 106 nears the point of sewing, a plurality of ruffles 216 are stitched into the gusset 110 so that the gusset 110 is a continuous piece of gusset material. This eliminates the need for mitering the gusset material.

Figure 3:
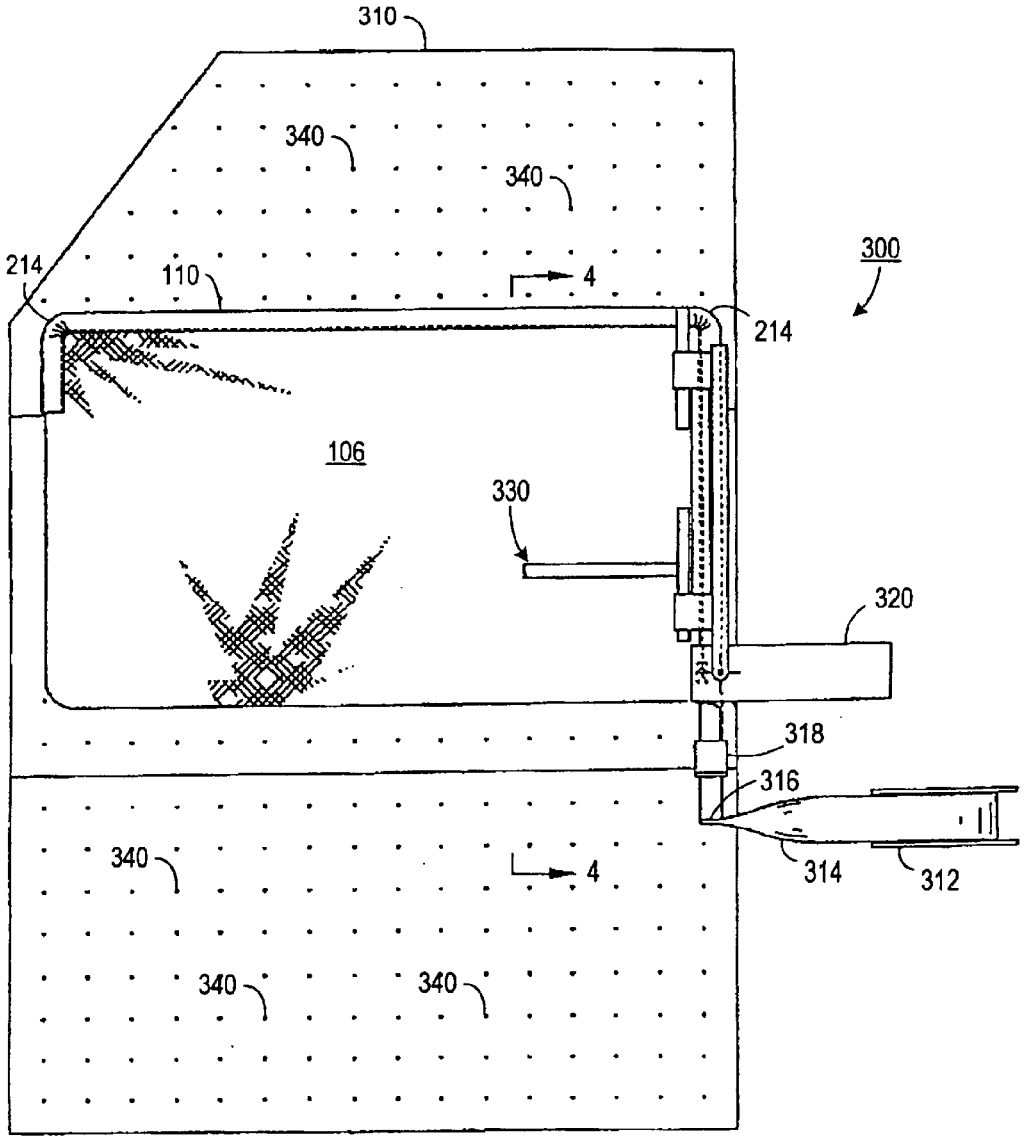
FIG. 3 is a top plan view of a gusset manufacturing machine according to an illustrative embodiment of the invention.

A gusset sewing system 300 is shown in FIG. 3. The sewing system 300 includes an air table 310, a sewing machine 320, a supply reel 312 for the gusset material 314, a folding device 316, a ruffler 318 (also referred to as a pleat generator) and a turning device 330 for turning the panel 106 as the corner 214 approaches the sewing machine 320. The air table 310 includes a plurality of openings 340 through which air is forced to provide an air cushion between the table 310 and the panel 106, thereby facilitating movement of the panel 106.

Figure 4:
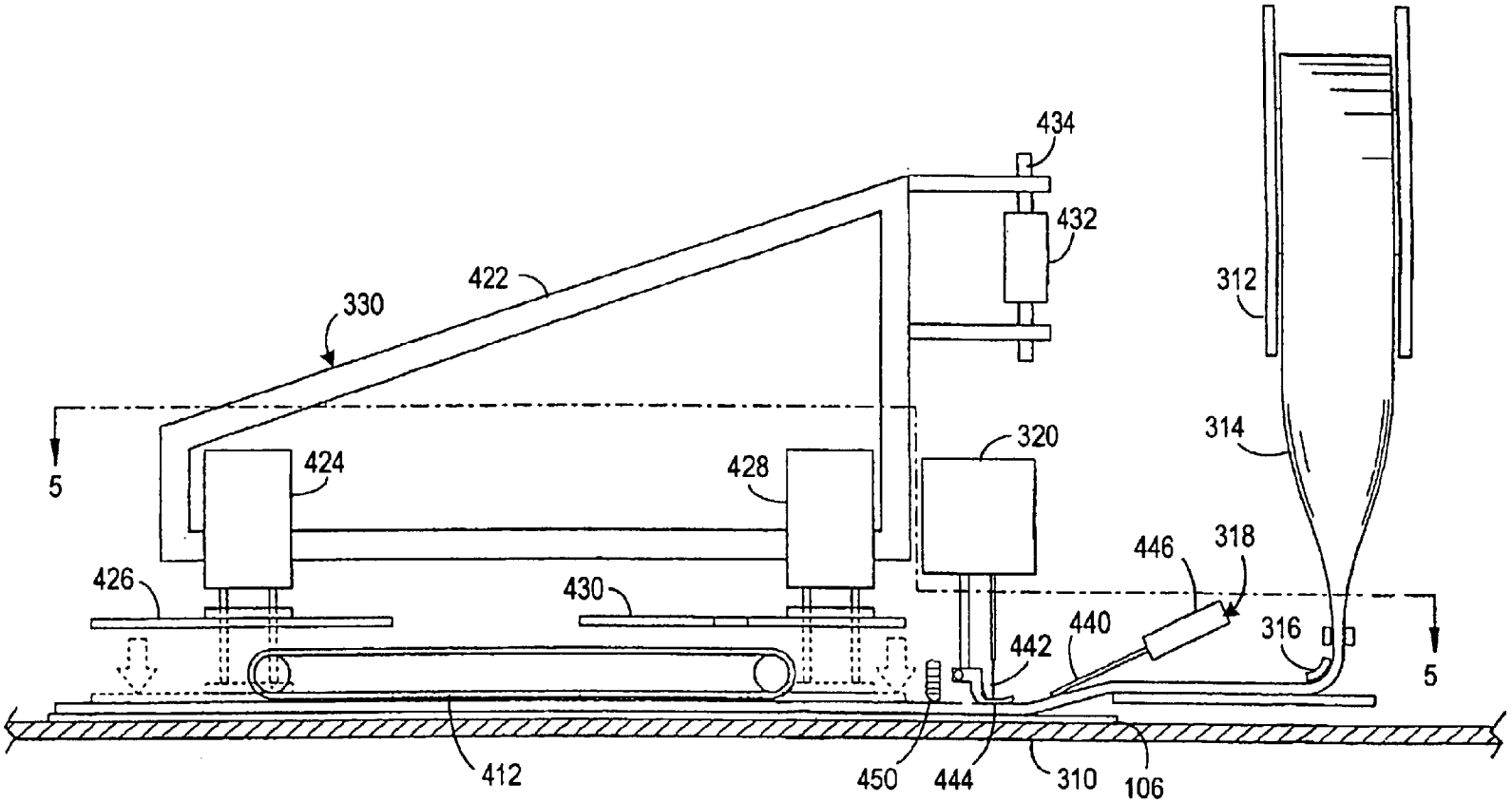
FIG. 4 is an elevational view of the gusset manufacturing machine shown in FIG. 3, as viewed from lines 4—4.

As shown in FIG. 4, the turning device 330 includes a frame 422 that supports a first pneumatic actuator 424 and a second pneumatic actuator 428. The frame 422 is affixed to a support 434 that is coupled to the table 310. A cornering actuator 432 is coupled to the frame 422 so as to be able to rotate the frame 422 between a first position and a second position. The first pneumatic actuator 424 is capable of raising and lowering a first arm 426 and the second pneumatic actuator 428 is capable of raising and lowering a second arm 430. The first arm 428 and the second arm 430 work in concert to engage and turn the panel 106 at the corners of the panel.

A conveyor 412 moves the panel 106 along a linear path when the corners are not being sewn. A guide wheel 450 keeps the panel 106 running along a substantially straight line during sewing. The guide wheel 450 is controlled by an optical sensor (not shown) that directs the edge of the panel 106 to a predetermined point when the edge of the panel 106 deviates from the predetermined point.

The sewing machine 320 includes a needle 442 and a sewing foot 444 for holding the gusset material 314 against the panel 106. The ruffler 318 includes a plunger assembly 446 and a ruffler foot 440. The plunger assembly 446 is capable of driving the ruffler foot 440 back and forth to push ruffles (also referred to as pleats) into the gusset material 314. The plunger assembly 446, in one embodiment, includes a pneumatic piston that is controlled so as to push the gusset material 314 into a ruffle when the needle 442 is in an "up" position and to retract the ruffler foot 440 when the needle is in a down position.

Figure 5A:
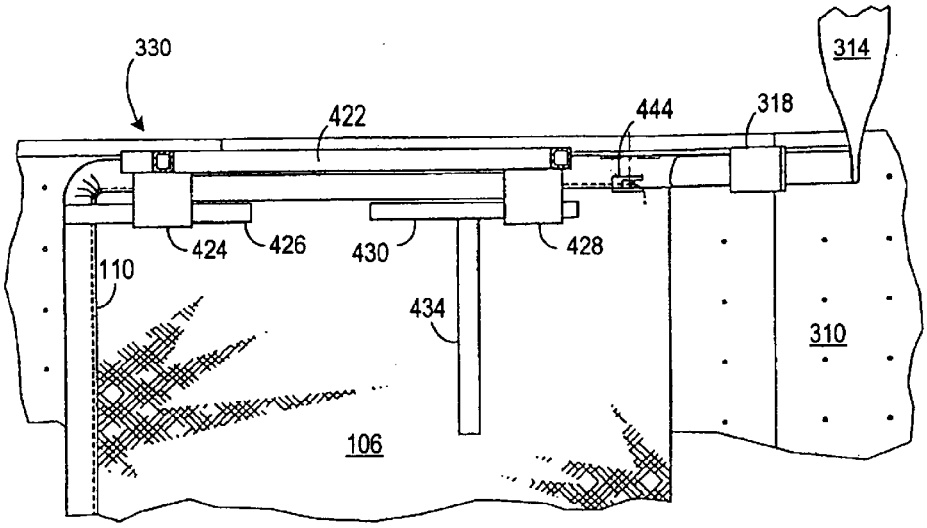
FIG. 5A is a top plan view of a portion of the gusset manufacturing machine shown in FIG. 4, as viewed from line 5—5, while in the process of sewing a gusset to a strait edge of a panel.
Figure 5B:
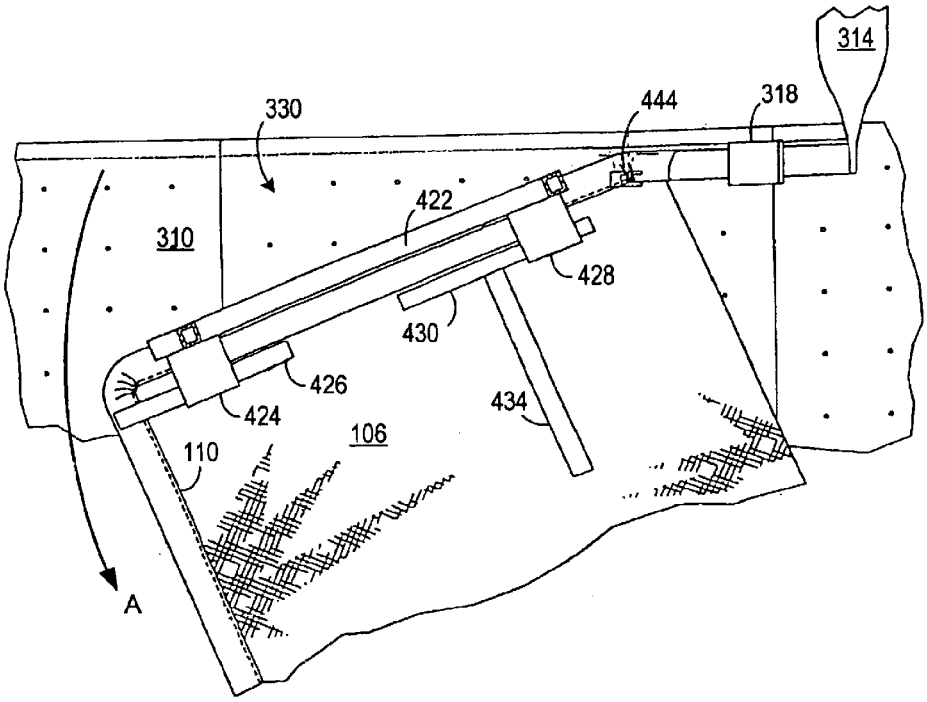
FIG. 5B is a top plan view of a portion of a gusset manufacturing machine shown in FIG. 4, as viewed from line 5—5, while in the process of sewing a gusset to a corner of a panel.

The turning device 330, as shown in FIGS. 5A and 5B, can include a transverse arm 434 extending from second arm 430. The transverse arm 430 helps to prevent the panel 106 from becoming bunched-up during a turn. Straight sewing is shown in FIG. 5A, whereas the turning operation is shown if FIG. 5B. Essentially, the turning device 330 causes the arms 426, 430 and 434 to engage the panel 106 and the frame 422 is rotated in the direction of arrow A as the corner ruffling is sewn into the panel 106.

Figure 6:
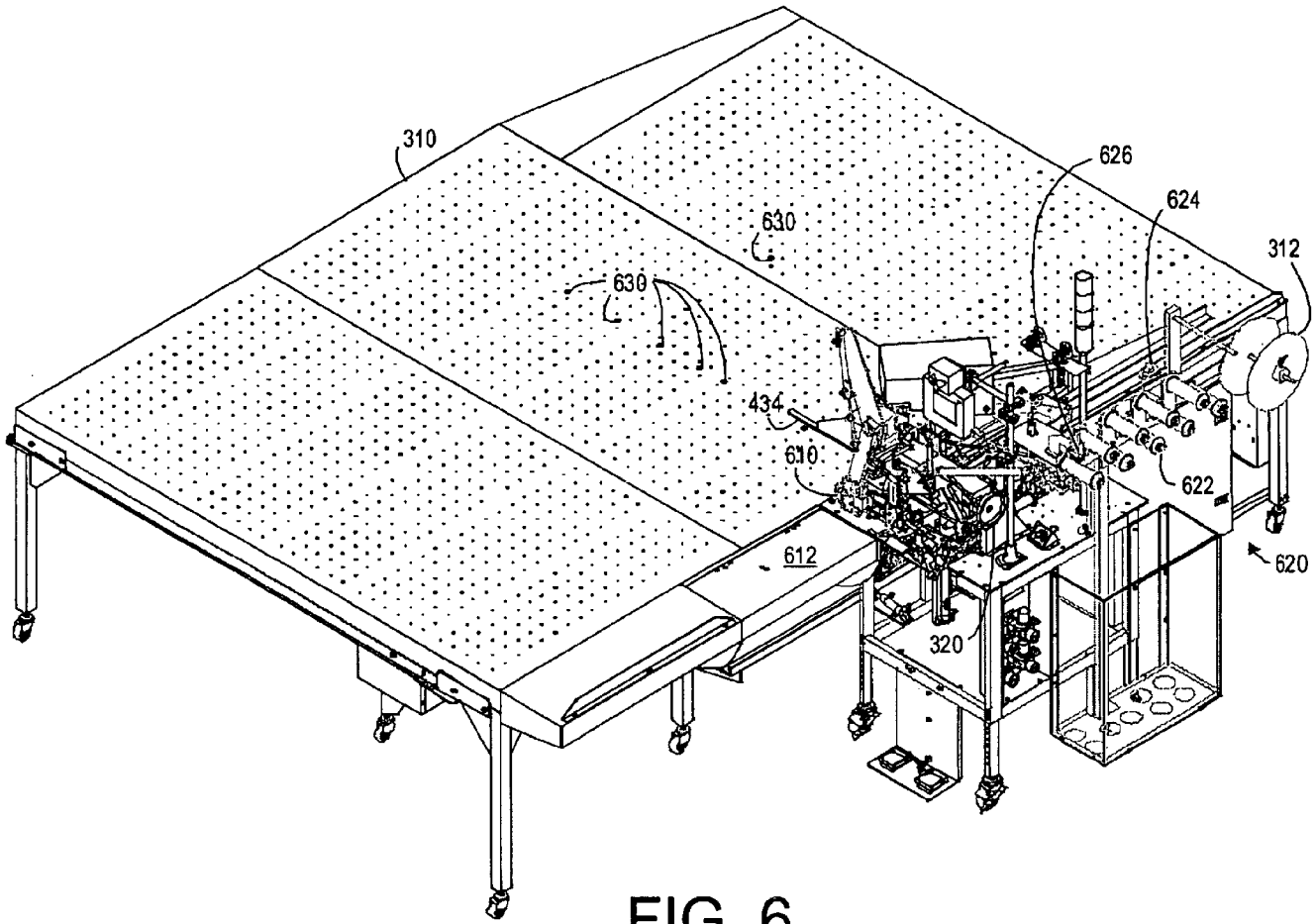
FIG. 6 is a top perspective view of a sewing table employing several aspects of the invention.

As shown in FIG. 6, the gusset sewing system can include a gusset-cutting knife 610 that can extend outwardly from the sewing machine 320 at the termination of the gusset sewing process. The knife 610 can include a pneumatically-driven blade that cuts the gusset material. To allow an operator to gain access to the sewing machine 320 while the knife 610 is in the retracted position, a trap door 612 is included in the table 310. The trap door 612 may be driven by a pneumatic piston and controlled so that the trap door 612 is in the "up" position during the automatic part of the sewing process and when the knife 610 is in the extended cutting position. The trap door 612 is driven to the down position when the operator is needed to control the sewing machine 320 at the termination of the sewing process, after the gusset has been cut by the knife 610.

A plurality of controllable directional air jets 630 are included in the air table 310 to provide directional jets of air when the panel is being moved so as to prevent bunching up of the panel. The directional jets of air are aimed toward the direction of intended movement, which can include along the normal linear path taken by the panel and along the turning direction of the panel while the corners are being ruffled. Air flow to the directional air jets 630 can be controlled to provide more or less force on the panel, depending on the needs of the panel. For example, heavier panel materials would require more force, as would more porous panel materials. Also, as a panel becomes heavier as a result of gusset material being sewn thereto, the airflow may be increased. Air flow control may be accomplished either by controlling the speed of the blowers that provide the air supply for the air table and the directional air jets or by opening or shutting louvers at the intake to the blowers.

An accumulator 620 may be included to ensure that sufficient gusset material is available to complete an entire panel. At the start of the sewing process, a clamp 626 holds the gusset material in a fixed position as the accumulator 620 pays out from the reel 312 onto a plurality of rollers 622 (two rows of which expand away from each other) a length of gusset material required for a given panel. An optical sensor 624 detects whether the gusset material covers all of the rollers 622 (the last one of which may be covered with a reflective material). If the last roller is not covered with gusset material, then the operator is notified through an alarm. If insufficient gusset material exists for a panel, the operator can determine, by counting the number of rollers that are interleaved with the gusset material, the operator can determine if there is sufficient gusset material to edge a smaller-sized panel (e.g., a twin-size mattress panel, rather than a full-size panel).

Figure 7:
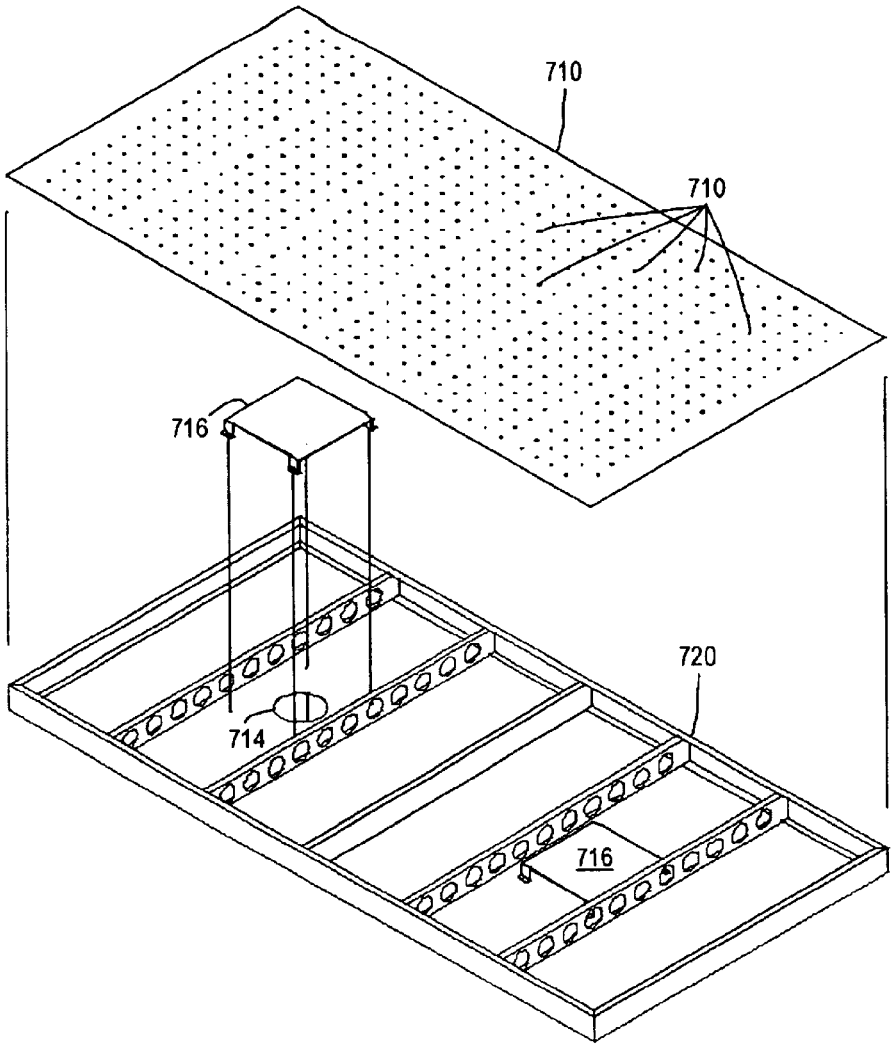
FIG. 7 is an exploded top perspective view of an air table employed in one embodiment of the invention.

An exploded view of a section 700 of an air table is shown in FIG. 7. The section 700 includes a surface portion 710 that defines a plurality of openings 712 passing there through. The surface portion 710 is sealed to a manifold 720 that includes at least one passage 714 to an air supply (not shown), which could comprise one of many types of blowers generally available. A baffle 716 is disposed above the passage 714 to prevent local high concentrations of air flow through the surface portion 710.

Figure 8:
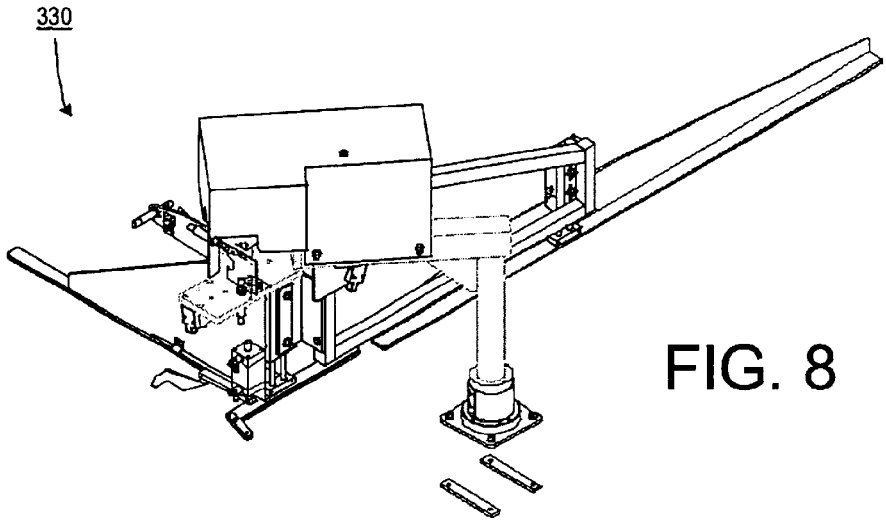
FIG. 8 is a top perspective view of a mechanism for rotating a panel about a corner, according to one aspect of the invention.
Figure 9:
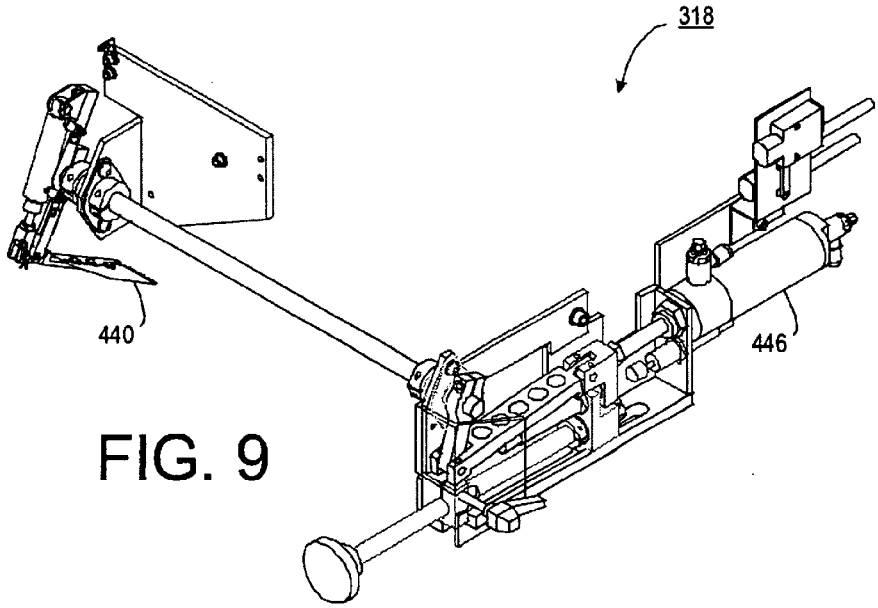
FIG. 9 is a top perspective view of a ruffler, according to one aspect of the invention.
Figure 10:
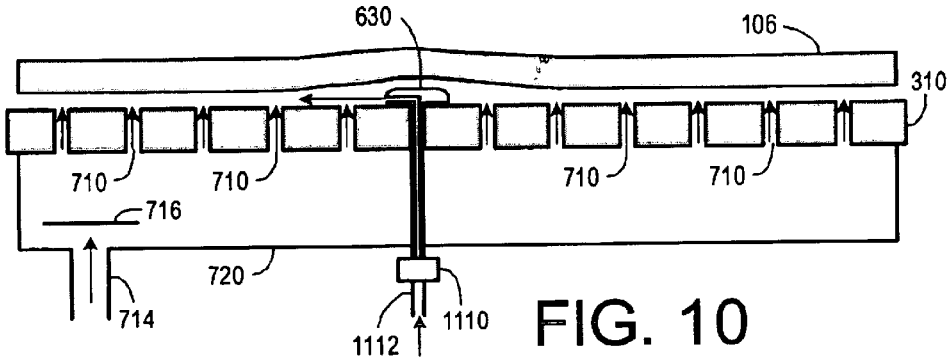
FIG. 10 is a side cross-sectional view of an air table employing directional air jets, according to one aspect of the invention.

The turning mechanism 330 is shown in greater detail in FIG. 8 and the ruffler 318 is shown in greater detail in FIG. 9. A detail of a directional air jet 630 and the air table 310 is shown in FIG. 10. The directional air jet 630 is supplied by an air supply 1112 and controlled remotely by a solenoid 1110.

Figure 11:
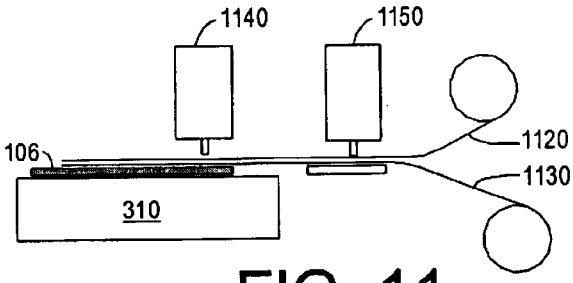
FIG. 11 is a side elevational view of an apparatus for sewing both a gusset and a flange to a panel, according to one aspect of the invention.

In one embodiment, as shown in FIG. 11, the gusset material 1120 and the flange material 1130 may be sewn to the panel 106 in a single operation. To do this, the system requires a first sewing machine 1150 for sewing the flange material 1130 to the gusset material 1120 and a second sewing machine 1140 for sewing the combined gusset/flange to the panel 106.

Figure 12:
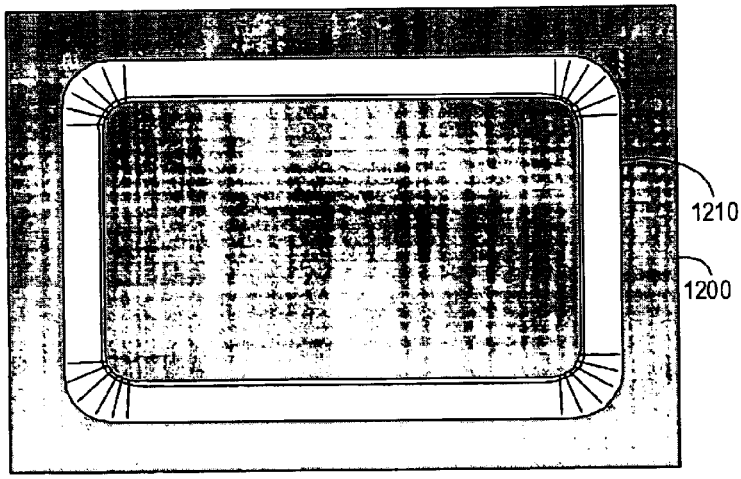
FIG. 12 is a top plan view of a panel with a recessed gusset, according to one aspect of the invention.

In one embodiment of a panel/gusset combination, as shown in FIG. 12, the gusset 1210 may be sewn to the panel 1200 so as to leave a predetermined width of panel 1200 extending away from the gusset 1210. In this embodiment, the extra panel material eliminates the need for a flange, as the periphery of the panel 1200 is attached directly to the side wall of the mattress body.

The above described embodiments are given as illustrative examples only. It will be readily appreciated that many deviations may be made from the specific embodiments disclosed in this specification without departing from the invention. Accordingly, the scope of the invention is to be determined by the claims below rather than being limited to the specifically described embodiments above.

What is claimed is:

1. An apparatus for attaching a gusset to a panel, comprising:

a. a gusset folder that receives and folds a gusset material to form the gusset for attachment to the panel;

b. a sewing table on which the panel is received and supported for sewing;

c. a sewing machine positioned relative to the sewing table so as to be able to sew the gusset to the panel;

d. a gusset guide for guiding the gusset fed to the sewing machine toward a selected edge of the panel so that the gusset is held in substantial alignment with the edge of the panel;

e. an edge detector that detects when a next edge of the panel is approaching the sewing machine;

f. a pleat generator that selectively forms a pleat in a portion of a gusset as the gusset is being sewn to the panel by the sewing machine; and g. a turning mechanism positioned along the sewing table and moveable into engagement with the panel to turn the panel relative to the sewing the when the edge detector detects the next edge of the panel is approaching the sewing machine.

2. The apparatus of claim 1, wherein the pleat generator comprises a pleat formation blade moveable in timed relation to the sewing of the gusset to engage and form at least one pleat in the gusset as the panel is turned by the turning mechanism to form a ruffed gusset corner on the panel.

3. The apparatus of claim 1, further comprising a material conveyor that engages the gusset on the panel and advances the gusset and panel together past the sewing machine as the sewing machine sews the gusset to the panel.

4. The apparatus of claim 3 wherein the material conveyor comprises a rotationally driven belt that engages the gusset material in position upon the panel.

5. The apparatus of claim 1, wherein the sewing table comprises a surface upon which the panel may rest and at least one air chamber into which air is forced and from which air flows trough a plurality of holes defined by the surface of the table.

6. The apparatus of claim 5, further comprising a plurality of directional air jets that direct air parallel to the sewing table so as to move the panel in a predetermined direction.

7. The apparatus of claim 6, further comprising an air jet air flow controller that turns on the directional air jets when assistance is needed to move the panel and that turns off the directional air jets when no assistance is needed.

8. The apparatus of claim 5, further comprising an air flow controller that controls airflow through the plurality of holes.

9. The apparatus of claim 8, wherein the air flow controller is programmable so as to cause an increase in air flow as the panel becomes heavier as gusset material is being sewn thereto.

10. The apparatus of claim 8, wherein the air flow controller is programmable so as to increase air flow for more porous panel materials.

11. The apparatus of claim 8, wherein the air flow controller is programmable so as to increase air flow for heavier panel materials.

12. The apparatus of claim 1, wherein the pleat generator includes:

a. a pleat formation blade that is coupled to the sewing machine so as to have a position and a spaced apart second position and so that a pleat is formed in the gusset when the pleat formation blade moves from the fist position to the second position; and b. an actuator that selectively moves the pleat formation blade from the first position to the second position.

13. The apparatus of claim 12, wherein the pleat generator further comprises:

a. a sewing machine state sensor that generates a signal indicative of a position of the sewing needle;

b. a ruffler controller that causes the actuator to move the pleat formation blade to the second position when the sewing machine state sensor indicates that the sewing needle is moving to an upward position.

14. The apparatus of claim 13, wherein the sewing machine comprises an external rotor that rotates as the sewing needle moves and wherein the sewing machine state sensor comprises:

a. an optical sensor directed to the external rotor; and b. a reflective material disposed on a predetermined position on the external rotor and positioned so that as the external rotor moves to a predetermined position, the optical sensor will sense movement of the reflective material.

15. The apparatus of claim 13, wherein the sewing machine is controlled by a sewing machine controller that is coupled to the ruffler controller that causes the sewing machine to operate at a relatively fast rate when the pleat generator is not operating and that causes the sewing machine to operate at a relatively slow rate when the pleat generator is operating.

16. The apparatus of claim 1, further comprising a gusset tensioning device that is capable of controlling tension on the gusset as the gusset is being sewn to the panel so that the tension on the gusset is within a desired range for a characteristic of the gusset.

17. The apparatus of claim 16, wherein the characteristic of the gusset comprises ability of the gusset material to stretch.

18. The apparatus of claim 16, wherein the characteristic of the gusset comprises direction of sewing relative to the panel.

19. The apparatus of claim 1, wherein the edge detector comprises:

a. a piece of reflective material disposed at a predetermined location on the table; and b. an optical sensor that senses when the piece of reflective material is uncovered.

20. The apparatus of claim 1, further comprising a movable knife that is capable of cutting the gusset material after the gusset has been sewn to the panel.

21. An apparatus for attaching a gusset to a panel, comprising:

a. an accumulator that draws out the gusset material from a source along a path having a predetermined length, the predetermined length being sufficient for the first purpose;

b. a detector that generates a signal that indicates that there is insufficient gusset material in the accumulator for the first purpose;

c. a gusset folder that receives and folds a gusset material to form the gusset for attachment to the panel;

a sewing table on which the panel is received and supported for sewing;

e. a sewing machine positioned relative to the sewing table so as to be able to sew the gusset to the panel;

f. a gusset guide for guiding the gusset fed to the sewing machine toward a selected edge of the panel so that the gusset is held in substantial alignment with the edge of the panel;

g. an edge detector that detects when a next edge of the panel is approaching the sewing machine; and h. A turning mechanism positioned along the sewing table and moveable into engagement with the panel to turn the panel relative to the sewing machine when the edge detector detects the next edge of the panel is approaching the sewing machine.

22. The apparatus of claim 21 wherein the path has a first end adjacent the source and an opposite second end and wherein the detector generates the signal when there is no gusset material at the first end of the path.

23. The apparatus of claim 21, wherein the accumulator includes indicia that indicate when there is enough gusset material sufficient for a second purpose, different from the first purpose.

24. The apparatus of claim 21, wherein the accumulator comprises:

a. a first plurality of rollers that are evenly spaced apart;

b. a second plurality of rollers evenly spaced apart;

c. a mechanism that moves the second plurality of rollers from a first position, in which the second plurality of rollers arm interleaved with fist plurality of rollers, to a second position in which the second plurality of rollers is spaced apart from the first plurality of rollers, so that when the gusset material is interleaved between the first plurality of rollers and the second plurality of rollers, and when the second plurality of rollers is moved from the fist position to the second position, a length of the gusset material is drawn from the supply.

25. The apparatus of claim 24, wherein the detector comprises:

a. a reflective material disposed adjacent the source of the gusset material; and b. an optical sensor disposed so as to be able to detect when the reflective material is covered by the gusset material.

26. The apparatus of claim 25, further comprising a clamp disposed adjacent to a selected roller of the first plurality of rollers, the clamp capable of holding the gusset material against the selected roller while the second plurality of rollers moves to the second position.

27. A method of sewing a gusset to a panel, comprising the steps of:

a. sewing, with a sewing machine, the gusset to the panel along a first substantially linear path;

b. detecting a corner of the panel;

c. turning the panel when the corner of the panel approaches the sewing machine so that the gusset follows a curved path adjacent the corner of the panel;

d. creating at least one pleat in the gusset in a region that is adjacent to the corner of the panel;

e. sewing the pleat onto the panel; and f. sewing the gusset to the panel along a second substantially linear path, angularly divergent from the from the first substantially linear path after the gusset has been sewn around the corner of the panel.

28. The method of claim 27 and wherein the step of creating at least one pleat comprises detecting movement of a needle of the sewing machine toward a raised position, engaging the gusset with a pleat formation blade as the needle is in its raised position and forming the pleat in the gusset, and moving the pleat formation blade away form engagement with the gusset as the needle is moved into engagement with the pleat.

29. The method of claim 27, wherein the step of sewing the gusset to the panel comprises sewing at a first desired rate of sewing, and varying the rate of sewing as the panel is turned.

30. The method of claim 29, further comprising the step of reducing the rate of sewing of the gusset to the panel as at least one pleat is formed in the gusset.

31. The method of claim 27 further comprising the step of accumulating a predetermined length of gusset material sufficient to form a gusseted panel of a desired size.

32. A system for attaching a gusset to a panel, comprising:

a. a gusset forming station for automatically forming the gusset from a strip of gusset material;

b. a sewing table having an upper surface supporting the panel as the gusset is attached thereto;

c. a sewing machine adjacent the upper surface of the sewing table, positioned along sewing path for the panel, for attaching the gusset to the panel;

d. a pleat generator for forming at least one pleat in the gusset at a desired location about the panel, said pleat generator operated in timed relation with said sewing machine, sewing the gusset to the panel; and e. a system controller controlling a sewing operation for attaching the gusset to the panel, wherein said system control can control the sewing of the gusset to the panel at varying rates to enable high speed sewing of the gusset to the panel and sewing at a different rate for generation of the pleats in the gusset as needed.

33. The system of claim 32, further comprising a clamp arm for engaging and turning the panel upon detection of the approach of an edge of the panel to said sewing machine.

34. The system of claim 32, wherein ad sewing table includes a plurality of ports formed in said upper surface thereof for providing an air flow to the panel moving over said upper surface.

35. The system of claim 32, wherein said sewing table further includes at least one directional air jet for applying a directional air flow to the panel.

36. The system of claim 32, wherein said gusset forming station includes an accumulator for accumulating predetermined lengths of gusset material from a supply, a folder for folding the gusset material, and a sewing machine for sewing the folded gusset material and attaching a flange material to form a flanged gusset.

37. A system for attaching a gusset to a panel, comprising:

a. a gusset forming station for forming the gusset from a strip of gusset material;

b. a sewing table having a table surface for supporting the panel as the gusset is attached thereto;

c. a sewing machine adjacent the table surface, positioned along a sewing path for the panel, for attaching the gusset thereto;

d. a system controller controlling a sewing operation for attaching the gusset to the panel, the system control including programming for controlling the sewing of the gusset to the panel at varying rates for sewing the gusset to the panel and enabling generation of pleats in the gusset during sewing as needed; and e. wherein the sewing machine table includes a series of ports formed in the table surface thereof for supplying an air flow to the panel supported on the sewing table, the air flow being variable by the system controller to accommodate variations in the size, weight or material of the panel being sewn.

38. A gusset for attachment to a panel, having at least one first corner, the gusset comprising a strip of gusset material having a first edge and a second edge, the strip of gusset material being folded substantially along a centerline, the first edge of the gusset material being sewn to the first panel, the gusset defining at least one pleat that uses the gusset material to change direction, the at least one pleat being placed adjacent to the first corner.

39. The gusset of claim 38, wherein the at least one pleat extends partially across a width of the gusset material.

40. The gusset of claim 38, further comprising a plurality of pleats forming a ruffled corner, whereby the direction of the gusset material is altered by substantially ninety degrees.

41. The gusset of claim 38, further comprising a plurality of pleats that are substantially evenly spaced.

42. The gusset of claim 38, wherein the gusset material is continuous about a perimeter of the panel.

43. The gusset of claim 38, wherein the at least one pleat does not extend across an entire width of the gusset material.

44. The gusset of claim 38, further comprising a mattress, the first panel being attached to the mattress.

45. The gusset of claim 38, wherein the gusset material is made of mattress upholstery material.

46. An apparatus for attaching a gusset to a panel comprising:

a. a gusset folder that receives and folds a gusset material to form the gusset for attachment to the panel;

b. a sewing table on which the panel is received and supported for sewing;

c. a sewing machine positioned relative to the sewing table so as to be able to sew the gusset to the panel;

d. a gusset guide for guiding the gusset fed to the sewing machine toward a selected edge of the panel so that the gusset is held in substantial alignment with the edge of the panel;

e. an edge detector that detects when a next edge of the panel is approaching the sewing machine; and f. a turning mechanism having a swing frame positioned along the sewing table, a clamp am moveable into engagement with the panel, and a drive mechanism for moving the clamp arm about an arcuate path to turn the panel relative to the sewing machine when the edge detector detect the next edge of the panel is approaching the sewing machine.

47. The apparatus of claim 46, wherein the clamp arm has an angular configuration and engages the panel proximate to a corner of the panel.

48. An apparatus for attaching a gusset to a panel, comprising:

a gusset folder that receives and folds a gusset material to form the gusset for attachment to the panel;

b. a sewing table on which the panel is received and supported for sewing;

c. a sewing machine positioned relative to the sewing table so as to be able to sew the gusset to the panel;

d. a gusset guide for guiding the gusset fed to the sewing machine toward a selected edge of the panel so that the gusset is held in substantial alignment with the edge of the panel;

e. an edge detector that detects when a next edge of the panel is approaching the sewing machine;

f. a turning mechanism positioned along the sewing table and moveable into engagement with the panel to turn the panel relative to the sewing machine when the edge detector detects the next edge of the panel is approaching the sewing machine; and g. a movable knife capable of cutting the gusset material after the gusset has been sewn to the panel; wherein the knife has an extended position and a retracted position and wherein the table includes a door portion hingedly attached to the table, and defining a door opening suitable for an operator to access the sewing machine, and a controllable actuator that raises the door portion when the knife is in its extended position, thereby blocking the door opening.

* * * * *